US006860405B1

(12) United States Patent
Poynter

(10) Patent No.: US 6,860,405 B1
(45) Date of Patent: Mar. 1, 2005

(54) DISPOSABLE SINGLE-USE CONTAINER WITH INDICIA BEARING PORTION

(75) Inventor: Richard Q. Poynter, Crystal Lake, IL (US)

(73) Assignee: R.P. Scherer Technologies, Inc., Las Vegas, NV (US)

( * ) Notice: Subject to any disclaimer, the term of this patent is extended or adjusted under 35 U.S.C. 154(b) by 13 days.

(21) Appl. No.: 10/654,662

(22) Filed: Sep. 3, 2003

(51) Int. Cl.[7] ..... B67D 5/30

(52) U.S. Cl. ..... 222/23; 222/209; 222/215; 222/541.6

(58) Field of Search ..... 222/23, 209, 215, 222/541.6

(56) References Cited

U.S. PATENT DOCUMENTS

| | | | | |
|---|---|---|---|---|
| 4,995,519 A | | 2/1991 | Rose et al. | 215/32 |
| 5,678,736 A | * | 10/1997 | Hansen | 222/209 |
| 5,845,264 A | | 12/1998 | Nellhaus | 705/28 |
| 6,241,124 B1 | | 6/2001 | Hoyt | 222/143 |
| 6,357,626 B1 | | 3/2002 | Zhang et al. | 222/78 |

* cited by examiner

*Primary Examiner*—Philippe Derakshani
(74) *Attorney, Agent, or Firm*—Donald O. Nickey; Gallagher & Dawsey

(57) ABSTRACT

A container and storage apparatus with an attached, but functionally separate, labeling portion is provided. The apparatus has a primary chamber containing a predetermined agent separated from the labeling portion. An optional contamination barrier region may increase the separation. A preferred embodiment may be formed by a blow-fill-seal method from thermoplastic, allowing one piece molding of the apparatus. A removable cap allows a dispensing point to be opened into the primary chamber for removal of the agent. Indicia may be formed in or on the labeling portion, which may be smaller, larger, or the same in size and shape as the primary chamber. Inks, adhesives or other substances incidental to the indicia will be less likely to migrate across the apparatus wall and into the primary chamber due to the functional separation provided between the primary chamber and labeling portion.

27 Claims, 4 Drawing Sheets

DISPOSABLE SINGLE-USE CONTAINER WITH INDICIA BEARING PORTION

FIELD OF THE INVENTION

The instant invention relates to a container and storage apparatus; particularly, a blow-fill-seal container formed with an indicia bearing labeling portion.

BACKGROUND OF THE INVENTION

Glass containers, with their inherent fragility, sharp edges after fracture, and possibility of introducing fragments into the contents of the container, are increasingly being replaced by plastic containers. Containers made of such materials as polyethylene, polypropylene, and polyvinyl chloride are frequently utilized, and are generally produced by a process of "blow-fill-seal" (BFS), in which the containers are mechanically blow molded, filled, and then sealed in a continuous operation.

BFS containers typically comprise a main chamber, holding the desired contents, and a head portion. A relatively narrow neck forms an outlet channel from the main chamber into the head portion, and this outlet channel is sealed by a frangible membrane that is typically formed by placing a crimp across the head portion during the molding and sealing process. At the time of use, the head portion is broken away from the main chamber portion, thus opening the outlet channel and allowing removal of the contents. A prototypical example of a BFS container is seen in U.S. Pat. No. 4,995,519 to Rose, et al. Alternatively, other methods of sealing the container, such as a foil membrane with a pull-tab, may be used to seal the container, as seen in U.S. Pat. No. 6,357,626 to Zhang, et al.

BFS containers, since they are not typically resealable, have found special application in dispensing unit dose contents, particularly unit dose liquid medicaments. Typical of such use is U.S. Pat. No. 6,241,124 to Hoyt. The '124 device is specifically designed to handle sterile, preservative-free formulations, such as those used in single dose eye drop applications.

While representing a definite advance in packaging, BFS containers as they are currently manufactured share a number of drawbacks. As they are generally designed to handle unit dose, or otherwise small quantifies of material, they are generally small, slippery, and difficult to handle. Their small size makes it very difficult to engrave or affix indicia that adequately describe the contents in a size that may readily be discerned by the human eye. In particular, persons with presbyopia or diminished vision generally have a very difficult time reading the small print generally present on such containers. Additionally, the materials from which these containers are compounded are often permeable to inks, adhesives, or other substances such that labeling indicia cannot be imprinted on the container, or even sometimes on labels affixed to the container, without potentially contaminating the contents. Because of the commonality of many BFS container designs, these containers tend to look very much alike, creating dangerous points of confusion in utilizing such containers.

Recent developments in safety labeling have compounded some of the problems associated with BFS containers. There is an increasing trend toward labeling various materials, in particular drugs, with machine-readable codes, more commonly known as bar codes.

A typical system of utilizing bar codes to track, in this case, drugs, is seen in U.S. Pat. No. 5,845,264 to Nelhaus.

In the '264 device, machine readable bar codes are placed on various medications, which may be read by a scanner and compared with a computer database of drug information. When combined with bar codes associated with individual persons, pharmacies, or caregivers, discernment and comparison of the various bar codes can be used to generate a plurality of information regarding drug administration. In particular, drug administration can be regulated to minimize the chances of incorrect drug administration, which is widely recognized to be a significant factor in medical treatment related morbidity and mortality.

However, attaching bar codes to BFS containers has proven problematic. The BFS containers are themselves often small, and it is difficult to encode sufficient machine-readable code in a small space to be useful. This is compounded by the necessity of sharing space on the container with visually discernable printing, which must not be covered or otherwise obscured by the machine-readable code. The attachment of an opaque, or even translucent, label, may tend to obscure the contents of the container. Because of the problems of substance migration through BFS packaging, it is often not practical to print bar codes directly on the containers, or even on labels affixed directly to the containers, and heretofore there has been no other practical place to put such code.

Accordingly, what the art has needed is a single-use container and storage apparatus designed to incorporate a lab ling portion to safely and reliably bear indicia, without minimizing or obscuring the labeling on such containers. The labeling portion should be functionally separated from those parts of the walls of the BFS container which enclose the contents of the container in order to prevent migration of substances incidental to labeling through the walls of the BFS container and into the container contents, and yet be physically part of the BFS container in order to prevent separation of the labeling from the container. The containers should be distinctive in appearance, and should be simple and inexpensive to manufacture with a minimum of fabrication steps. The instant invention answers these, and other, needs.

SUMMARY OF THE INVENTION

In its most general configuration, the present invention advances the state of the art with a variety of new capabilities and overcomes many of the shortcomings of prior devices in new and novel ways. In its most general sense, the present invention overcomes the shortcomings and limitations of the prior art in any of a number of generally effective configurations.

In one of the simplest configurations, the instant invention provides a disposable single-use container and storage apparatus containing a predetermined agent. The apparatus has a primary chamber, a labeling portion that is functionally separated from the primary chamber, and a removable cap.

The primary chamber is closed by a removable cap releasably attached to the primary chamber such that a dispensing point capable of placing the inner surface of the primary chamber in fluid communication with a surrounding environment is formed when the removable cap is removed. The removable cap may be made of a dissimilar material from the apparatus, such as a foil cap that is heat-sealed to the apparatus. Alternatively, the removable cap may be integrally formed and further include at least one cap chamber wherein the cap chamber is in fluid communication with the primary chamber across a frangible break line. In such an embodiment, the dispensing point is formed when the removable cap is removed from the apparatus at the frangible break line.

The shortcomings of the prior art devices are addressed by the inventive apparatus in providing a labeling portion functionally separated from the primary chamber. The functional separation may be accomplished by placing a contamination barrier region between the primary chamber and the labeling portion. The labeling portion may be placed in any practical spatial relationship to the primary chamber, and, in a preferred embodiment, is placed proximally and close to the primary chamber. In alternate embodiments, it may be placed distal to the cap and relatively far from the primary chamber, or may even be lateral to the primary chamber.

The labeling portion may be attached by any number of methods, including, in a preferred embodiment, being integrally formed with the apparatus. Such integral formation may be by a number of methods, and includes, as would be understood by one skilled in the art, casting or molding, and in particular, by a blow-fill-seal method of fabrication. Additionally, the labeling portion may be attached to the primary chamber with an adhesive, or by any of a number of material joining techniques, including by way of example and not limitation, chemical, mechanical, thermal, or other joining technologies.

The labeling portion may be formed of a solid material, or in a preferred embodiment, may have at least one interior surface and at least one exterior surface. In those embodiments having at least one interior surface and at least one exterior surface, the labeling portion may be configured to have at least one pressure equalization channel allowing the surrounding environment to be in fluid contact with the at least one interior surface of the labeling portion. The pressure equalization channel minimizes the adverse effects associated with a closed gas-filled space. For example, variations in atmospheric pressure would not tend to crush or expand a labeling portion with an open pressure equalization channel. A substantially hollow labeling portion allows the apparatus to be made of less material (lighter weight), is less expensive, and easily suited to blow-fill-seal manufacturing techniques. Further, the addition of a labeling portion gives such an apparatus additional gripping surfaces which make handling and opening of the apparatus easier.

The apparatus may be formed in a wide variety of shapes and sizes, including, but not limited to, a labeling portion being substantially cylindrical in shape. Similarly, the primary chamber may be formed in virtually any size and shape. In order to facilitate identification of the contents, the apparatus may bear at least one indicia located on the labeling portion. The indicia may be formed in the material of the apparatus, an adhesive indicia label may be affixed to the exterior surface of the labeling portion, or a shrink-wrap sleeve may be mounted to the labeling portion. An optional contamination barrier region, formed between the labeling portion and the primary chamber, may help to functionally isolate the primary chamber from the labeling portion and thus make any solvents, inks, or other substances incidental to the indicia less likely to migrate from the labeling portion across the wall of the primary chamber and to contaminate the contents of the apparatus. The apparatus may be formed by a blow-fill-seal method, well known to those skilled in the art, and may be formed of a thermoplastic, such as, by way of example and not limitation, polycarbonate, polyethylene, polyester, polystyrene, polypropylene, polysulfone, polyurethane, polyvinyl chloride and ethylene-vinylacetate. Certain materials, such as polyethylene, provide additional qualities to the invention, such as compressibility of the walls of the vial, which allows the walls to tend to collapse as fluid is being withdrawn with a syringe. This tends to prevent the establishment of a vacuum within the vial, and lessens the tendency for non-sterile ambient air to be drawn into the interior of the vial.

While the labeling portion may be, in one embodiment, substantially cylindrical in order to facilitate labeling, the apparatus may be formed in virtually any shape, size, or color. In alternate embodiments, the apparatus may be formed to have a certain shape or color associated with a certain predetermined agent, such that users will tend to associate a distinctive shape or color of the apparatus with certain known agents.

Thus, there is disclosed a disposable single-use container and storage apparatus containing a predetermined agent, wherein the apparatus has a proximal end and a distal end, comprising:

a primary chamber, having at least one interior surface in contact with the agent and at least one exterior surface in contact with a surrounding environment;

a removable cap, releasably attached to the primary chamber and substantially near the distal nd of the apparatus, having at least one gripping surface, such that a dispensing point capable of placing the inner surface of the primary chamber in fluid communication with a surrounding environment is formed when the removable cap is removed from the apparatus; and a labeling portion, attached to the apparatus which comprises at least one interior surface, at least one exterior surface and at least one pressure equalization channel wherein said equalization channel allows the surrounding environment to be in fluid contact with said at least one interior surface of the labeling portion.

There is further disclosed a storage apparatus containing a predetermined agent, wherein the apparatus has a proximal end and a distal end, comprising:

a primary chamber, having at least one interior surface in contact with the agent and at least one exterior surface in contact with a surrounding environment;

a removable cap, integrally molded to the primary chamber and substantially near the distal end of the apparatus, having at least one gripping surface, such that a dispensing point capable of placing the inner surface of the primary chamber in fluid communication with the surrounding environment is formed when the removable cap is removed from the apparatus, wherein the removable cap further includes at least one cap chamber wherein the cap chamber is in fluid communication with the primary chamber across a frangible break line, such that the dispensing point is formed when the removable cap is removed from the apparatus at the frangible break line; and a labeling portion, attached to the apparatus, having at least one interior surface and at least one exterior surface;

and a contamination barrier region formed between the labeling portion and the primary chamber.

There is also disclosed a disposable single-use container and storage apparatus made by a blow-fill-seal method, containing a predetermined agent, wherein the apparatus has a proximal end and a distal end, comprising:

a primary chamber, having at least one interior surface in contact with the agent and at least one exterior surface in contact with a surrounding environment;

a removable cap, integrally molded to the primary chamber and substantially near the distal end of the apparatus, having at least one gripping surface, such that a dispensing point capable of placing the inner surface of the primary chamber in fluid communication with the surrounding environment is formed when the removable cap is removed from the apparatus, wherein the removable cap further includes at least one cap chamber wherein the cap chamber is in fluid communication with the primary chamber across a frangible break line, such that the dispensing point is formed when the removable cap is removed from the apparatus at the frangible break line; and a labeling portion, substantially cylindrical in shape, attached to the apparatus, having at least one interior surface and at least one exterior surface, and including at least one pressure equalization channel allowing the surrounding environment to be in fluid contact with the at least one interior surface of labeling portion; and a contamination barrier region formed between the labeling portion and the primary chamber.

BRIEF DESCRIPTION OF THE DRAWINGS

Without limiting the scope of the present invention as claimed below and referring now to the drawings and figures:

DETAILED DESCRIPTION OF THE INVENTION

The container and storage apparatus of the instant invention enables a significant advance in the state of the art. The preferred embodiments of the apparatus accomplish this by new and novel arrangements of elements that are configured in unique and novel ways and which demonstrate previously unavailable but preferred and desirable capabilities.

The detailed description set forth below in connection with the drawings is intended merely as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the claimed invention.

Figure 1:
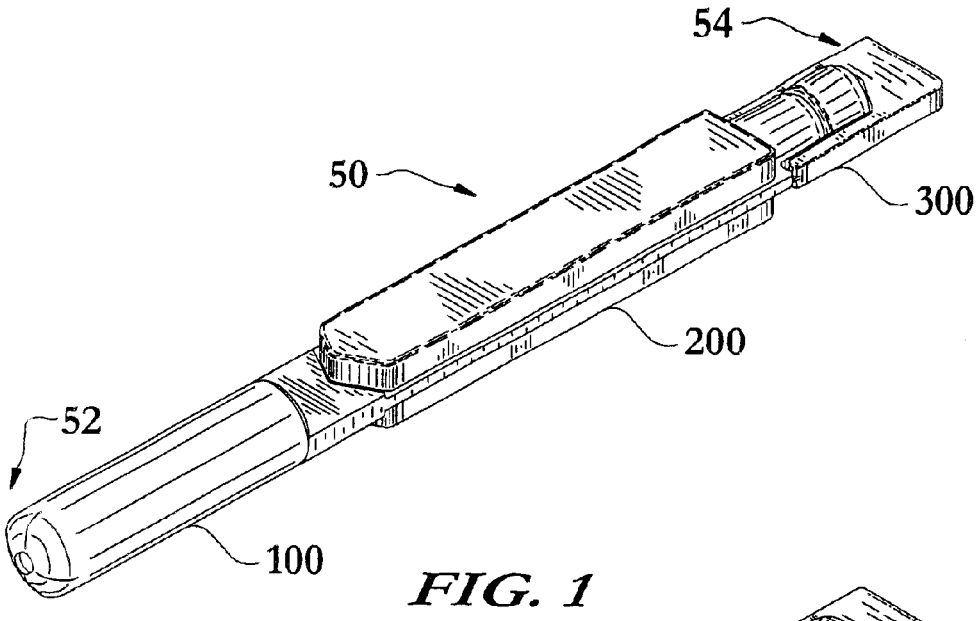
FIG. 1 shows an elevated perspective view, not to scale, of one embodiment of the apparatus of the instant invention in its sealed state.
Figure 2:
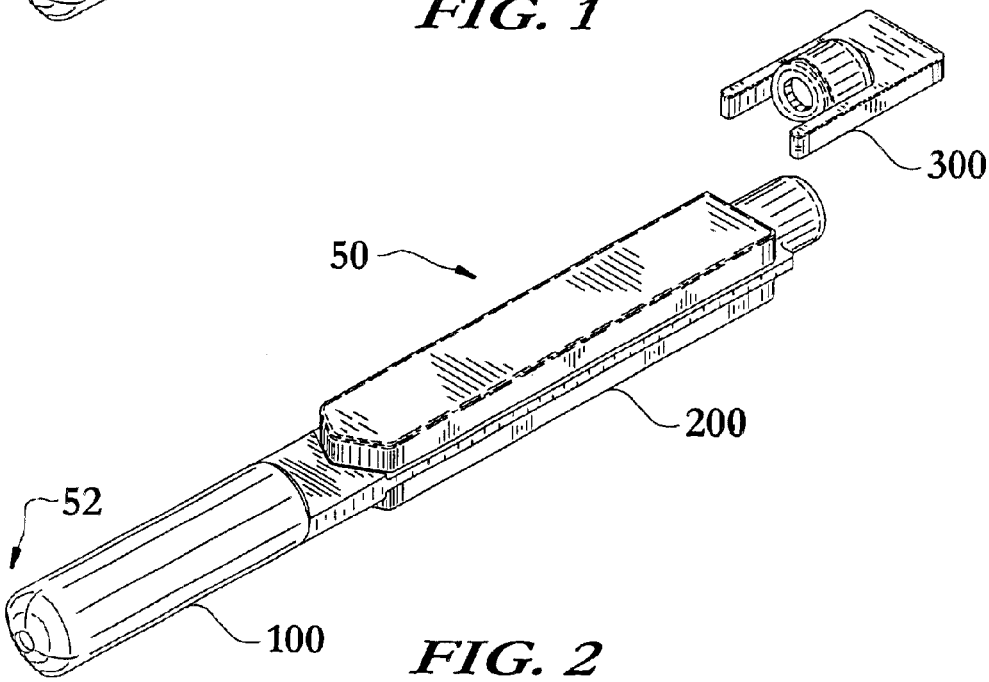
FIG. 2 shows an elevated perspective view, not to scale, of the embodiment of FIG. 1 with the removable cap removed and placed next to the apparatus.
Figure 3:
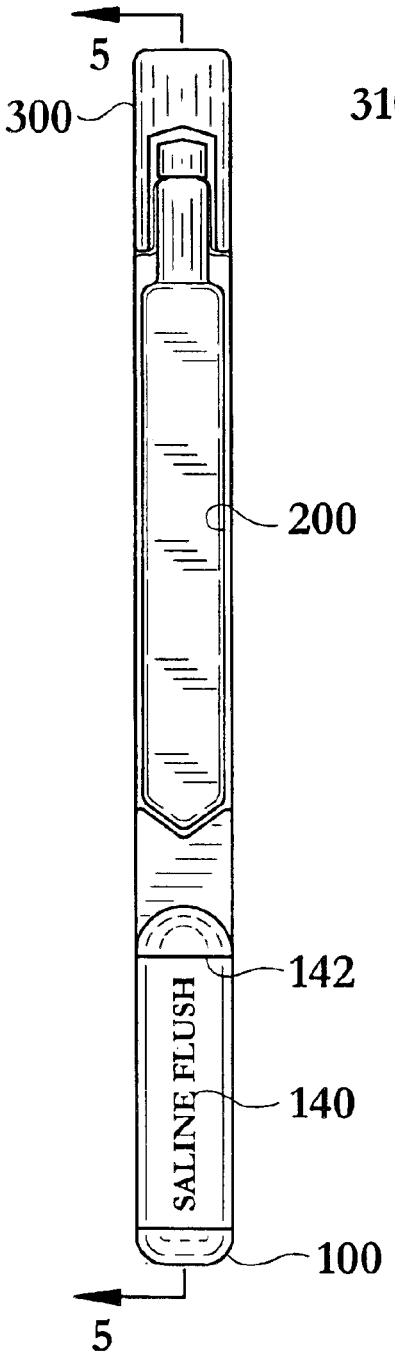
FIG. 3 shows a top plan view, not to scale, of the embodiment of FIG. 1.
Figure 4:
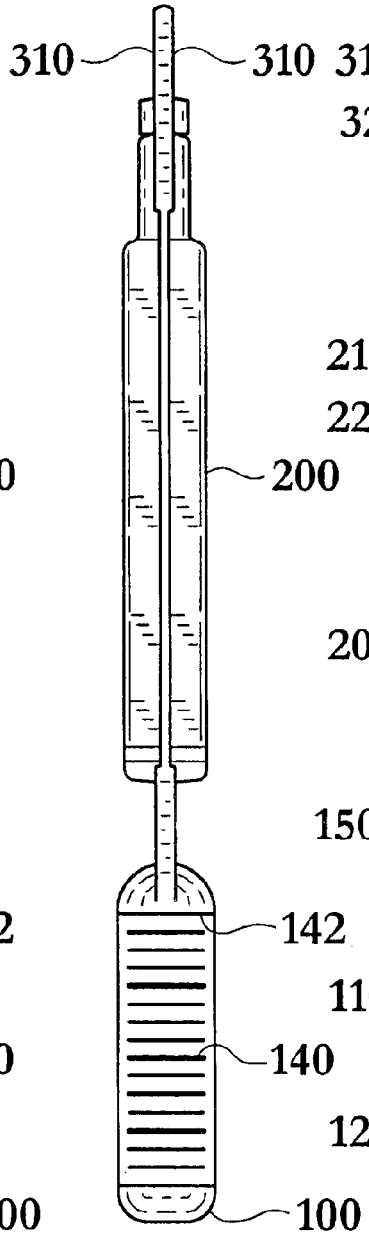
FIG. 4 shows a side plan view, not to scale, of the embodiment of FIG. 1.
Figure 5:
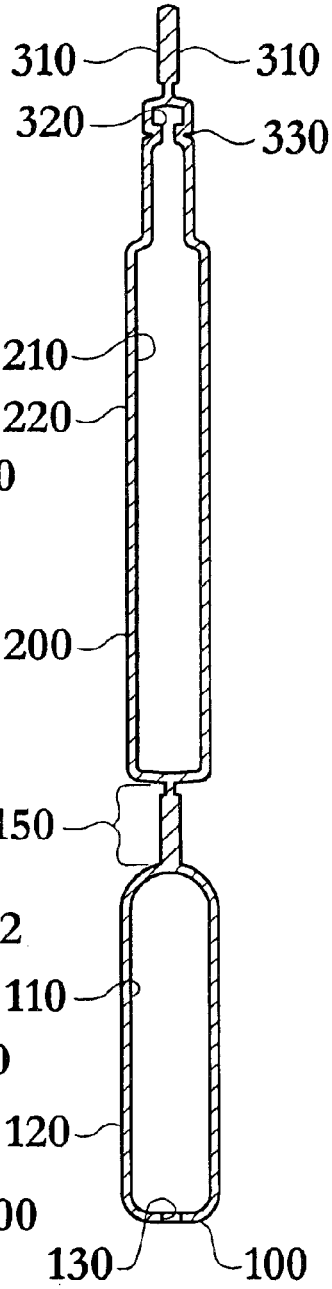
FIG. 5 shows a section view, not to scale, of the embodiment of FIG. 3, taken along section line 55.

Referring generally to FIGS. 1 through 10, the instant invention includes an integrally molded disposable single-use container and storage apparatus 50, a labeling portion 100, a primary chamber 200, and a removable cap 300. The apparatus 50 has a proximal end 52 and a distal end 54, as seen in FIG. 1 and FIG. 2. The primary chamber 200, seen in FIGS. 1 through 8, has at least on interior surface 210 in contact with the stored material (i.e. a liquid pharmaceutical) and at least one exterior surface 220 in contact with a surrounding environment. This is best seen in FIG. 5.

Figure 6:
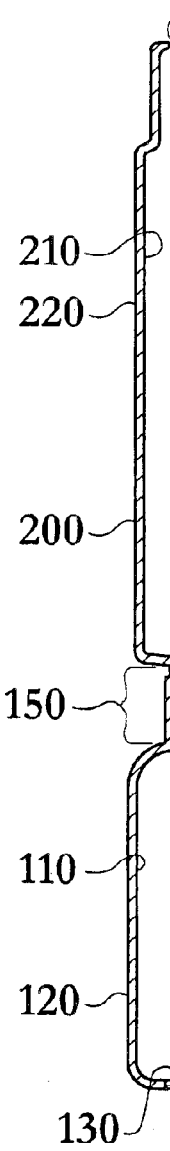
FIG. 6 shows a section view, not to scale, of the embodiment of FIG. 5, shown with the removable cap removed.

The primary chamber 200 is closed by a removable cap 300, seen in FIGS. 1 through 8, releasably attached to the primary chamber 200 and substantially near the distal end 54 of the storage apparatus 50. The removable cap 300 has at least one gripping surface 310, such that a dispensing point 230, seen in FIG. 6, capable of placing the inner surface 210 of the primary chamber 200 in fluid communication with the surrounding environment is formed when the removable cap 300 is removed from the apparatus 50 (the container is opened). The removable cap 300, by way of example and not limitation, may be made of a material dissimilar from the storage apparatus 50. For example, a foil cap may be heat sealed to the storage apparatus 50. Alternatively, and in a preferred embodiment, seen in FIG. 5, the removable cap 300 further includes at least one cap chamber 320 wherein the cap chamber 320 is in fluid communication with the primary chamber 200 across a frangible break line 330, such that the dispensing point 230, as seen in FIG. 6, is formed when the removable cap 300 is removed from the storage apparatus 50 at the frangible break line 330.

Figure 11:
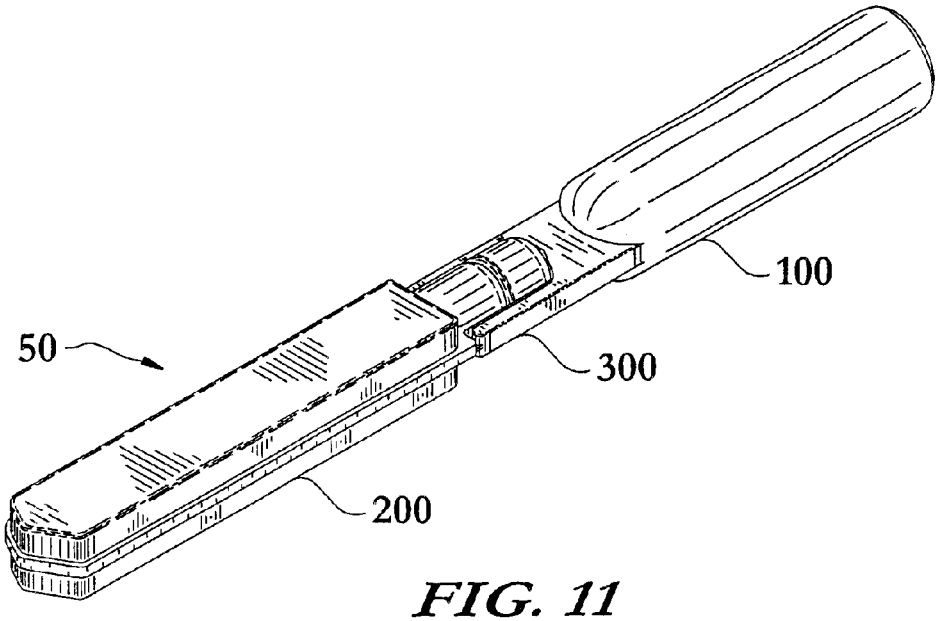
FIG. 11 shows an elevated perspective view, not to scale, of one embodiment of the apparatus of the instant invention in its sealed state.
Figure 12:
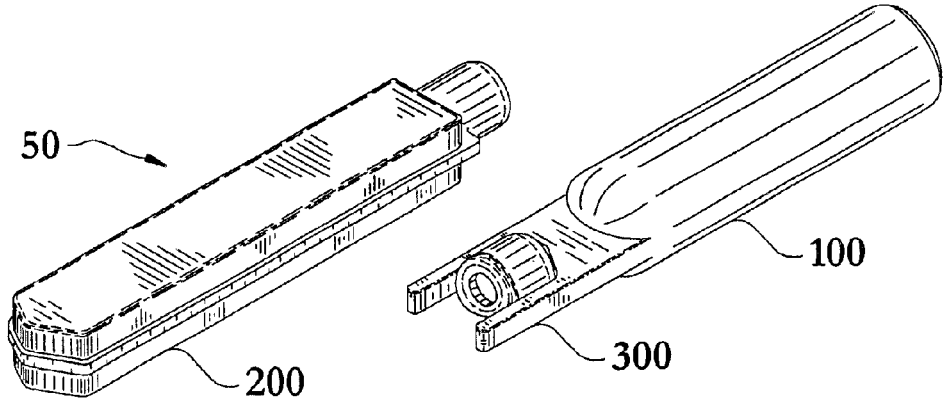
FIG. 12 shows an elevated perspective view, not to scale, of the embodiment of FIG. 11 with the removable cap removed and placed next to the apparatus.

Further shortcomings of the prior art storage apparatuses are addressed by the apparatus 50 having a labeling portion 100, attached to the apparatus 50, seen in FIGS. 1 through 12. The labeling portion 100 may be placed in any practical spatial relationship to the primary chamber 200; and, in a preferred embodiment, as seen in FIGS. 1–10 the labeling portion 100 may be placed proximally and close to the primary chamber 200. In alternate embodiments, as seen in FIGS. 11 and 12, the labeling portion 100 may be placed distal to the cap chamber 320 and relatively far from the primary chamber 200, or may even be lateral to the primary chamber. The labeling portion 100 may be separated from the primary chamber 200 by a contamination barrier region 150 formed between the labeling portion 100 and the primary chamber 200, as seen in FIGS. 1–10. In alternate embodiments, seen in FIGS. 11 and 12, the contamination barrier region 150 may separate the cap chamber 320 from the labeling portion 100. The labeling portion 100 may be formed of a solid material, or in a preferred embodiment, may have at least one interior surface 110 and at least one exterior surface 120.

In those embodiments having at least one interior surface 110 and at least one exterior surface 120, the labeling portion 100 may be configured to have at least one pressure equalization channel 130 allowing the surrounding environment to be in fluid contact with the at least one interior surface 110 of the labeling portion 100. The pressure equalization channel 130 minimizes the adverse effects associated with a closed gas-filled space in the labeling portion 100. A substantially hollow labeling portion 100 allows the apparatus 50 to be made of less material and with a lighter weight, is less expensive, and more feasibly suited to blow-full-seal manufacturing techniques.

Figure 7:
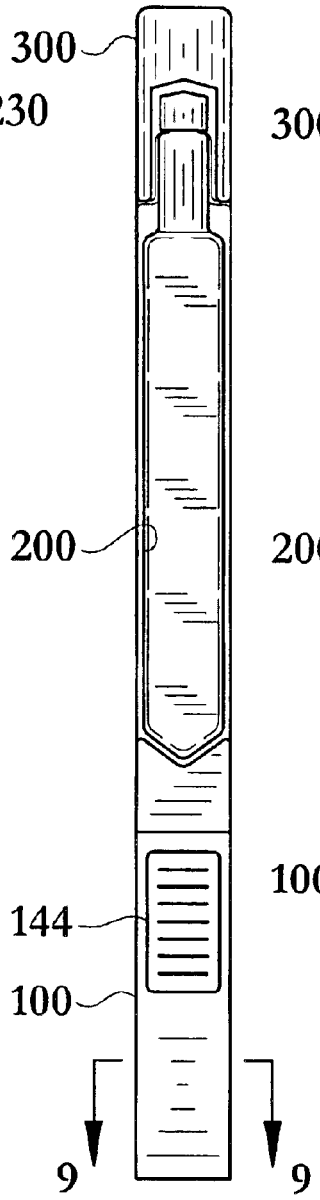
FIG. 7 shows a top plan view, not to scale, of an alternative embodiment of the apparatus of the instant invention.
Figure 8:
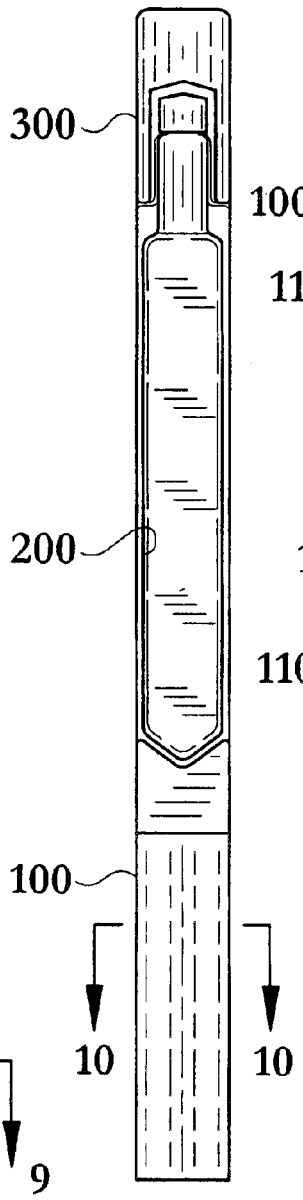
FIG. 8 shows a top plan view, not to scale, of another alternative embodiment of the apparatus of the instant invention.
Figure 9:
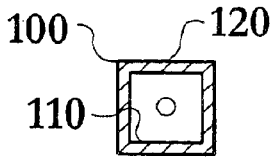
FIG. 9 shows a section view, not to scale, of the embodiment of FIG. 7, taken along section line 9—9.
Figure 10:
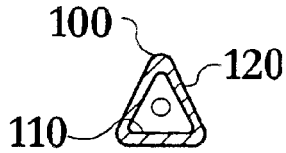
FIG. 10 shows a section view, not to scale, of the embodiment of FIG. 8, taken along section line 10—10.

The apparatus 50, may formed in a wide variety of shapes and sizes, including, but not limited to, a labeling portion 100 being substantially cylindrical in shape, as seen in FIGS. 3 through 6. Alternative shapes of the labeling portion 100, by way of example and not limitation, include substantially square profiles, as seen in FIGS. 7 and 9, and polyhedral profiles, illustrated by a substantially triangular profile in FIGS. 8 and 10. Similarly, the primary chamber 200 may be formed in virtually any size and shape.

In order to facilitate identification of the contents, the apparatus 50 may bear at least one indicia 140 located on the labeling portion 100, seen in FIGS. 3, 4, and 7. The indicia 140 may be carried on the apparatus 50 in a wide variety of manners. In one embodiment, indicia 140 is formed in the material of the apparatus 50. In another, seen in FIG. 7, an adhesive indicia label 144 is affixed to the exterior surface 120 of the labeling portion 100. In a preferred embodiment, seen in FIG. 4, the at least one indicia 140 is integral to at least one shrink-wrap sleeve 142 that is mounted to the labeling portion 100. The contamination barrier region 150, seen well in FIGS. 6 and 7, formed, in this embodiment, between the labeling portion 100 and the primary chamber 200, helps to insure that any solvents, inks, or other substances incidental to the indicia 140 are less likely to migrate across the wall of the primary chamber 200 and to contaminate the contents of the apparatus 50.

Studies were undertaken in one embodiment wherein the apparatus was fabricated of low density polyethylene (LDPE), to assess the potential for migration of volatile compounds from the indica 140 and the shrink-wrap sleeve 142, into the primary chamber 200. In summary of the protocol, potential migrants were identified from both shrink-wrap sleeves 142 and from the primary chambers 200 of unlabeled samples of the apparatus 50. Any migrants eventually detected in the contents of the primary chamber 200, which corresponded to migrants detected in the indicia 140 bearing shrink-wrap sleeves 142, but which did not correspond to migrants detected in the primary chamber 200 contents of unlabeled experimental examples of the apparatus 50, may be presumed to be migrants that passed from the indicia 140, across the walls of the primary chamber 200, and into the primary chamber 200 contents. Other detected compounds may migrate from the LDPE material of the apparatus 50.

Test 1

Extraction of Compounds from Indicia and Shrink-Wrap Sleeves

As a first step, a direct extraction and analysis of one embodiment of the indicia 140 bearing shrink-wrap sleeves 142 according to one embodiment was carried out to determine potential migrants that might later be detected in the primary chamber 200 contents. Indicia 140 was imprinted on shrink-wrap sleeves 142, and the shrink-wrap sleeves 142 bearing indicia 140 themselves had weight and surface area determined for the loose, that is, not affixed to apparatus 50, shrink-wrap sleeves 142. Indicia 140 bearing shrink wrap sleeves 142 were found to weigh, on average, 175 mg each, and had a one-side surface area of 11.25 $cm^2$. Four indicia 140 bearing shrink-wrap sleeves 142 were combined for extraction. The indicia 140 bearing shrink-wrap sleeves 142 were placed in a 50 ml borosilicate glass test tube sealed with a polytetrafluoroethylene-lined screw cap closure along with 40 ml of 10% ethanol (ETOH) in distilled water. The tube was tightly closed and incubated at 40° C. for 14 hours with constant agitation. Following incubation, the tube was cooled to room temperature and the indicia 140 bearing shrink-wrap sleeves 142 were removed. Internal standard (anthracene-$d_{10}$) at a concentration equivalent to 100 PPB (parts per billion) (w/v) relative to the 10% ETOH extraction solvent was spiked into the tube along with 5.0 ml of methylene chloride. The solution was extracted and then centrifuged at 2000 RPM for 30 minutes to promote complete phase separation. The lower methylene chloride layer was transferred to a 5 ml, conical bottomed vial, and concentrated under a gentle stream of nitrogen at room temperature to a final volume of approximately 100 $\mu$l. The concentrated extract was then analyzed by gas chromatography-mass spectrometry (GC-MS). A method analysis blank was performed and analyzed alongside the indicia 140 bearing shrink-wrap sleeves 142 and consisted of all reagents and work up procedure except for the absence of indicia 140 bearing shrink-wrap sleeves 142. Triplicate analyses were performed. The compounds detected in the direct extracts of the indicia 140 bearing shrink-wrap sleeves 142 were used to compile a target list of indicia 140 bearing shrink-wrap sleeve 142 borne extractables to check for as potential migrants in the primary chamber 200 contents. Table 1 is a summary of the indicia 140 bearing shrink-wrap sleeve 142 direct extraction results, and lists the compound detected in the 10% ETOH direct extract of the labels. The concentration data is expressed in parts per billion (PPB) w/w in the 10% ETOH extraction solvent. The mean and standard deviation values for the three replicate determinations are given.

TABLE 1

Compounds Detected in Direct Extraction of Labels (Indicia and Shrink-Wrap Sleeves)

| Compound | Concentration (Mean +/− S.D.)(PPB w/w) |
|---|---|
| Unknown compound 142 m.w., mono-chlorinated | 1.66 +/− 0.14 |
| 2,6-di-t-butylbenzoquinone | 0.54 +/− 0.37 |
| 2,6,di-t-butyl-p-hydroxyanisole (BHT methyl ether) | 3.79 +/− 0.37 |
| Unknown compound 154 mw. | 0.95 +/− 0.34 |
| Butylated hydroxyl toluene (BHT) | 0.18 +/− 0.03 |
| Neopentyl glycol-adipic acid cyclic diester (NPG-adiapte) | 17.94 +/− 0.77 |
| cis-isophorone diisocyanate (cis-IDPI) | 1.03 +/− 0.32 |
| Trans-isophorone diisocyanate (trans IPDI) | 6.46 +/− 1.36 |
| Tripropylene glycol (TPG) | 2.38 +/− 1.21 |
| 2,6-di-t-butyl-p-ethylphenol (Ionol II) | 0.40 +/− 0.14 |
| Dibutylphthalate | 1.44 +/− 0.23 |
| methyl abietate | 0.46 +/− 0.04 |
| di-(EG adipate) | 92.95 +/− 11.76 |
| EG, NPG-diadipate | 87.34 +/− 9.18 |
| di-(NPG adipate) | 25.38 +/− 3.83 |
| Ethylene glycol terephthalate oligomer I (EG-terephthalate) | 1.17 +/− 1.42 |
| Ethylene glycol terephthalate oligomer II (EG-terephthalate) | 19.94 +/− 4.97 |
| Tri-(EG-adipate) | 35.65 +/− 10.24 |
| EG-NPG adipate (3:1:3 oligomer) | 31.91 +/− 6.82 |
| EG-NPG-adipate (2:2:3) oligomer) | 18.33 +/− 1.62 |
| Total Direct Indicia Bearing Shrink-Wrap Sleeve 10% ETOH Extractables | 355.75 +/− 36.43 |

The analytical data on direct label extractables is in agreement with the reported composition of the base polymer shrink-wrap sleeves 142 and composition of the indicia 140 as reported for the particular embodiment studied. The base polymer of the shrink-wrap sleeve 142 in the particular embodiment was PET-G, which is a polyester based on polyethylene terephthalate. The direct label extractables found at highest concentration are all short chain polyester oligomers including ethylene glycol terephthalic acid esters and esters of ethylene glycol and neopentyl glycol with adipic acid. Two common polyurethane-type monomers were detected (cis and trans-isophorone diisocyanate) were detected, indicating the use of polyurethane-based inks in the printing of the indicia 140. Other monomer compounds included hindered-phenol type antioxidants, traces of plasticizers, and some rosin ester.

Test 2

Exaction from Unlabeled Samples of Apparatus

Next, an analysis of potential migrants derived from the material of the apparatus 50 was performed to identify potential migrants from the structural material of the apparatus 50 itself that might later be detected in the primary chamber 200 contents. Should such migrants be detected in the primary chamber 200 contents, and not be present in the direct extracts from the indicia 140 bearing shrink-wrap sleeves 142 as detailed in Table 1, it would be inferred that such compounds had originated from the body of the apparatus 50, rather than from the indicia 140 bearing shrink-wrap sleeves 142.

A total of 30 unlabeled examples of the apparatus 50 each containing 5 ml of 0.9% normal saline (NS) were stored at 40° and 60° C. for ten days in constant temperature chambers at 75% relative humidity (RH) and were then analyzed to establish a baseline for organic extractable components. The apparatus 50 contents were analyzed in triplicate. For each replicate, the contents from 10 examples of the apparatus 50 were pooled together and poured into a 70-ml size borosilicate glass test tube sealed with a polytetrafluoroethylene-lined screw cap closure. Internal standard (antracene-$d_{10}$) at a concentration equivalent to 10 PPB (w/w) relative to the 0.9% normal saline solution was spiked into the tube along with 5.0 ml of methylene chloride. The saline solution was extracted and centrifuged at 2000 RPM for 30 minutes to promote complete phase separation. The lower methylene chloride layer was transferred to a 5-ml conical bottomed vial and concentrated under a gentle stream of nitrogen at room temperature to a final volume of approximately 10.0 $\mu$l. The concentrated extract was then analyzed by GC-MS as previously described.

Tables 2 and 3 list the compounds detected in the methylene chloride extracts of the saline solution contents of the unlabeled examples of the apparatus 50. Concentration data is expressed units of parts per billion (PPB) w/w in the saline solution. In each case the mean and standard deviation values for the three replicate determinations are given.

TABLE 2

Compounds Detected in Normal Saline Solution of Unlabeled Sampl s of the Apparatus Stored at 40° C., 75% RH, for 10 Days

| Compound | Concentration (Mean +/− S.D.)(PPB w/w) |
|---|---|
| 2-butoxyethanol (Butyl Cellosolve) | 0.92 +/− 0.21 |
| Nonanal | 0.52 +/− 0.04 |
| 2-ethyhexanoic acid | 0.83 +/− 0.46 |
| octanoic acid | 0.87 +/− 0.12 |
| 2-phenoxy-1-propanol | 3.09 +/− 0.50 |
| caprolactam | 14.89 +/− 8.60 |
| nonanoic acid | 28.07 +/− 7.70 |
| p-isoamylphenol | 3.02 +/− 0.31 |
| Surfynol 104 | 0.27 +/− 0.15 |
| 2,6-di-t-butyl-phydroxyanisole (BHT methyl ether) | 0.90 +/− 0.26 |
| Butylated hydroxyl toluene (BHT) | 0.31 +/− 0.06 |
| o-hydroxybiphenyl | 2.94 +/− 0.43 |
| diethylphthalate (DEP) | 137.17 +/− 48.55 |
| Unknown 184 m.w. substance | 0.74 +/− 0.43 |
| ethylene glycol-adipic acid monoester (EG-adipate) | 0.96 +/− 0.24 |
| lauramide | 0.79 +/− 0.69 |
| dibutylphthalate | 6.03 +/− 7.08 |
| myristamide | 1.30 +/− 0.43 |
| palmitoleamide | 0.40 +/− 0.27 |
| palmitamide | 1.59 +/− 1.26 |
| oleamide | 0.28 +/− 0.16 |
| stearamide | 0.79 +/− 0.19 |
| di-2-ethylhexylphthalate (DEHP) | 2.39 +/− 2.42 |
| Erucamide | 3.48 +/− 2.60 |
| Mixture of short chain polyethylene oligomers (long chain hydrocarbons) | 3.07 +/− 2.82 |
| Total Methylene Chloride Extractables | 215.63 +/− 59.00 |

TABLE 3

Compounds Detected in Normal Salin Solution of Unlabeled Samples of the Apparatus Stored at 60° C., 75% RH, for 10 Days

| Compound | Concentration (Mean +/− S.D.)(PPB w/w) |
|---|---|
| Phenol | 1.04 +/− 0.40 |
| 2-butoxyethanol (Butyl Cellosolve) | 0.81 +/− 0.34 |
| nonanal | 0.62 +/− 0.43 |
| 2-ethylhexanoic acid | 2.59 +/− 0.60 |
| diethylene glycol, monobutyl ether | 15.63 +/− 5.73 |
| octanoic acid | 0.74 +/− 0.11 |
| 2-phenoxy-1-propanol | 0.62 +/− 0.18 |
| caprolactam + nonanoic acid | 11.21 +/− 5.05 |
| p-isoamylphenol | 0.27 +/− 0.12 |
| Surfynol 104 | 0.06 +/− 0.06 |
| 2,6-di-t-butyl-p-hydroxyanisole (BHT methyl ether) | 1.04 +/− 0.75 |
| butylated hydroxyl toluene (BHT) | 0.38 +/− 0.09 |
| o-hydroxybiphenyl | 41.33 +/− 26.44 |
| diethylphthalate (DEP) | 441.47 +/− 85.87 |
| unknown 184 m.w. | 0.95 +/− 0.58 |
| ethylene glycol-adipic acid monoester (EG-Adipate) | 0.84 +/− 0.55 |
| Lauramide | 1.07 +/− 1.27 |
| mixture of nonylphenol isomers (decomposition products of trisnonylphenylphosphite, TNPP stabilizer) | 3.95 +/− 2.05 |
| Diisobutylphthalate | 0.14 +/− 0.02 |
| Dibutylphthalate | 0.37 +/− 7.25 |
| Myristamide | 1.19 +/− 0.57 |
| Palmitoleamide | 6.47 +/− 4.92 |
| Palmitamide | 35.72 +/− 15.60 |
| Oleamide | 0.31 +/− 0.16 |
| Stearamide | 0.09 +/− 0.05 |
| di-2-ethylhexylphthalate (DEHP) | 0.15 +/− 0.07 |

TABLE 3-continued

| Compounds Detected in Normal Salin Solution of Unlabeled Samples of the Apparatus Stored at 60° C., 75% RH, for 10 Days | |
|---|---|
| Compound | Concentration (Mean +/− S.D.)(PPB w/w) |
| erucamide | 1.08 +/− 0.51 |
| mixture of short chain polyethylene oligomers (long chain hydrocarbons) | 2.24 +/− 1.28 |
| Total Methylene Chloride Extractables | 577.10 +/− 102.94 |

Trace levels of organic extractables were detected in the unlabeled samples. The compounds are mostly plastic migrants resulting from exposure of the saline to various polymeric materials it is processing history. They include antioxidants, plasticizers, slip additives (fatty acid amide derivatives), which are added to plastics as mold release agents or to reduce the coefficient of friction during processing, plastic oxidation products, solvents, surfactants, and monomers such as caprolactam (Nylon monomer) and short chain polyethylene oligomers. The profiles of the 40° and 60° C. samples were very similar with only several exceptions. The 60° C. samples contained some isomeric nonylphenols, which are decomposition products of a common plastic stabilizer called tris-(nonylphenyl) phosphate (TNPP). The 60° C. samples also uniquely contained traces of phenol, diisobutylphthalate and diethylene glycol, monobutyl ether. Several compounds found in both the direct label extracts (Table 1) and the unlabeled apparatus 50 sample primary chamber 200 contents (Tables 2 and 3) were the plasticizer dibutylphthalate and the two hindered-phenol type antioxidants BHT and BHT methyl ether. The level of these three components were very low in all samples, and as they were present in both the direct indicia 140 bearing shrink-wrap sleeve 142 extracts and the unlabeled apparatus 50 sample primary chamber 200 contents (Tables 2 and 3), they were disregarded as potential indicia 140 bearing shrink-wrap sleeve 142 migrants.

Test 3

Extraction from Apparatus Labeled According to an Embodiment of the Instant Invention After the list of potential migrants that might arise from the indicia 140 bearing shrink-wrap sleeves 142 of the experimental embodiment, as detailed in Table 1; and the material of the apparatus 50 itself, as detailed in Tables 2 and 3, was assembled, a comparison was undertaken to measure compounds appearing in the primary chamber 200 of the experimental apparatus 50 to identify those compounds which had migrated into the primary chamber 200 from the indicia 140 bearing shrink-wrap sleeves 142. In short, knowing which migrants might originate in the labels, and knowing which migrants may originate from the walls of the apparatus 50, allows a deduction as to the origin of any migrant eventually detected in the primary chamber 200.

A total of 30 labeled examples of the apparatus 50, each bearing indicia 140 printed on a shrink-wrap sleeve 142 according to one embodiment of the instant invention, and each containing 5 ml of 0.9% normal saline (NS) were examined for the presence of any compounds detected in both the direct extracts of the indicia 140 and shrink-wrap sleeves 142 and which were not present in the extractables found in unlabeled examples of the apparatus 50. The extraction and analysis protocol was the same as that used in Test 2. Extremely trace levels of two indicia 140 bearing shrink-wrap sleeve 142 migrants (polyester oligomers) were detected in the extracts of the labeled examples of the apparatus 50. A third adipate was detected only in those samples stored at 60° C. The concentration of these oligomers is summarized in Table 4. These compounds were presumptively identified, therefore, as having migrated into the primary chamber 200 contents from the indicia 140 bearing shrink-wrap sleeves 142.

TABLE 4

| Indicia and Shrink-wrap Sleeve Migrants Detected in Sterile Saline Solution Contents of Labeled Example of the Apparatus Stored at 40° C. and 60° C., 75% RH, for 10 Days | | | |
|---|---|---|---|
| | Concentration of Migrant in Saline Solution In PPB w/w (Mean +/− S.D.) | | |
| Sample Identification | ethylene glycol terephthalate oligomer 1 (EG-Terephthalate) | ethylene glycol terephthalate olig omer 2 (EG-Terephthalate) | ethylene glycol-adipic acid dimer di-(EG-Adipate) |
| Labeled Samples Stored at 40° C., 75% RH, 10 Days | 2.78 +/− 1.43 | 0.64 +/− 0.29 | N.D.* |
| Labeled Samples Stored at 60° C., 75% RH, 10 Days | 1.71 +/− 0.67 | 0.49 +/− 0.25 | 0.11 +/− 0.02 |

*Compound not detected in samples at this storage level temperature

Test 4

Extraction from Apparatus with Indicia and Shrink-wrap Label on Primary Chamber Exterior Surface ("Double-Lab led")

One of the experimental hypotheses of the instant invention is that there may be value, in reducing migration, of imposing a physical separation between the labeling portion 100 and the primary chamber 200 of the apparatus 50. To test this hypothesis, examples of the apparatus 50 were prepared with a second indicia 140 bearing shrink-wrap sleeve 142 covering the primary chamber 200, in addition to the indicia 140 bearing shrink-wrap sleeve 142 in the normal location of the preferred embodiment, that is, covering the labeling portion 100 of the apparatus 50. In this experiment, therefore, an indicia 140 bearing shrink-wrap sleeve 142 was placed directly on the primary chamber exterior surface 220. Accordingly, as with conventionally labeled prior art designs of this type, any migrant could reach the interior surface 210 of the primary chamber 200 by passage across the relatively thin wall separating the chamber interior surface 210 from the chamber exterior surface 220. This is to be contrasted with the design of the preferred embodiment, as seen in FIGS. 1–8, where, in order for a migrant to pass from the indicia 140 bearing shrink-wrap sleeve 142 to the interior surface 210 of the primary chamber 200, such migrant would have to traverse the physical separation between the labeling portion 100 and the primary chamber 200, including, in some embodiments, the contamination barrier region 150.

The experimental hypothesis was that such "double-labeled" apparatus 50, resembling prior art labeling, would display an increased level of migrants, as compared to the single labeled apparatus 50, as intended by the instant invention, as discussed above, and as detailed in Table 4. Additionally, it was hypothesized that the increase in migrants would be out of proportion to the approximate doubling in size of the labeled area of the apparatus 50, that is, the increase in level of migrants would not be linearly related to the increase in the labeled surface area caused by adding a second label. Accordingly, double-labeled apparatus 50 were prepared by placing a second indicia 140 bearing shrink-wrap sleeve 142 over the primary chamber 200. Storage, extraction, and analysis methodology exactly matching that of the single labeled samples, as detailed above and in Table 4, was performed. The results are summarized in Table 5.

TABLE 5

Indicia and Shrink-wrap Sleeve Migrants Detected in Sterile Saline Solution Contents of Double-Labeled Exampl of the Apparatus Stored at 40° C. and 60° C., 75% RH, for 10 Days

| Compound | Double-Labeled Apparatus 10 Days, 40° C., 75% RH (Mean +/− S.D.) (PPB w/w) | Double-Labeled Apparatus 10 Days, 60° C., 75% RH (Mean +/− S.D.)(PPB w/w) |
|---|---|---|
| Unknown 142 m.w. | 3.25 +/− 0.44 | 2.37 +/− 0.31 |
| NPG-Adipate | 33.78 +/− 5.25 | 43.79 +/− 2.92 |
| TPG | 5.92 +/− 0.69 | 5.88 +/− 1.04 |
| di-(EG-adipate) | 30.55 +/− 2.99 | 140.12 +/− 21.74 |
| EG/NPG-Adipate | 15.22 +/− 0.87 | 87.82 +/− 8.55 |
| di-(NPG-adipate) | 2.32 +/− 0.91 | 9.97 +/− 1.87 |
| EG-terephthalate oligomer 1 | 0.40 +/− 0.14 | 0.55 +/− 0.09 |
| EG-terephthalate oligomer 2 | 0.57 +/− 0.04 | 4.98 +/− 1.65 |
| tri-(EG-adipate) | N.D.* | 7.46 +/− 2.52 |
| EG-NPG-adipate (3:1:3) | N.D.* | 5.60 +/− 1.38 |

*Compound not detected in samples at this storage level temperature

Comparison of the results seen in Table 5 for the double-labeled apparatus 50 are in marked contrast to those of the preferred embodiment apparatus 50 summarized in Table 4. Placing a second indicia 140 bearing shrink-wrap sleeve 142 on the apparatus 50 resulted in migration of six additional compounds being detected at 40° C. storage temperatures, and in seven additional compounds being detected at 60° C. storage conditions.

Additionally, as to levels of the three migrant compounds that were detected at 60° C. storage conditions, in the preferred embodiment as seen in Table 4, there were some significant differences in some of these migrants as present in the double-labeled samples. For example, although there was little difference in the levels of EG-terephthalate oligomers seen as migrants in the single labeled and double-labeled specimens stored at 40° C., there was approximately a two and half times increase in these oligomers in the double-labeled samples stored at 60° C., (Table 5, sum of EG-terephthalate oligomer 1 and oligomer 2=5.53 PPB/mean), as compared to the single labeled samples stored at 60° C. (Table 4, sum of EG-terephthalate oligomer 1 and oligomer 2=2.20 PPB/mean). Even more remarkable was the difference in migration of di-(EG-adipate), which increased from 0.11 PPB +/−0.02 (Table 4) in the single labeled sample, to a mean of 140.12 +/−21.74 (Table 5) in the double-labeled sample, a more than one thousand fold increase.

Six compounds that were either not present, or below detection thresholds, in single labeled samples, were detected in the double-labeled samples stored at 40° C. (Unknown 142 m.w. substance, NPG-Adipate, TPG di-(EG-adipate), EG/NPG-Adipate, and di-NPG-adipate).
Additionally, in addition to these five, two compounds that were either not present, or below detection thresholds, in single labeled samples, were detected in the double-labeled samples stored at 60° C., tri-(EG-adipate) and EG-NPG-adipate (3:1:3).

In summary, the results of this series of experiments using a single embodiment of the instant invention, showed that migration of various compounds across the wall of the apparatus 50 could be mitigated by the design of the instant invention. It is to be noted that these experiments involved only a single embodiment of the instant invention, and that different design details, materials, and functional aspects of the instant invention may be incorporated in differing embodiments.

For example, the apparatus 50 may be formed by a number of blow-fill-seal and other methods, well know to those skilled in the art, and may be formed of a thermoplastic, such as, by way of example and not limitation, polycarbonate, polyethylene, polyester, polystyrene, polypropylene, polysulfone, polyurethane, polyvinyl chloride, and ethylene-vinylacetate. Certain materials, such as polyethylene, provide additional qualities to the invention, such as compressibility of the walls of the vial, which allows the walls to tend to collapse as fluid is being withdrawn with a syringe. This tends to prevent the establishment of a vacuum within the vial, and lessens the tendency for non-sterile ambient air to be drawn into the interior of the vial.

While the labeling portion 100 is, in one embodiment, substantially cylindrical in order to facilitate labeling, the apparatus 50 may be formed in virtually any shape, size, or color. The labeling portion 100 and the primary chamber 200 may be approximately the same size or shape as one another, or may be radically different in size and shape from each other. In alternate embodiments, the apparatus 50, or parts of the apparatus 50, may be formed to have a certain shape or color associated with a certain predetermined agent, such that users will tend to associate a distinctive shape or color of the apparatus 50 with certain known agents. By way of example and not limitation, topical agents could be manufactured in containers of a certain shape or color, while parenteral agents could be manufactured in a different shape or color. High hazard agents, such as chemotherapeutics or narcotics, could be packaged in especially distinctive colors or shapes. All such package coding would serve to decrease errors in agent identification.

Numerous alterations, modifications, and variations of the preferred embodiments disclosed herein will be apparent to those skilled in the art and they are all anticipated and contemplated to be within the spirit and scope of the claimed instant invention. For example, although specific embodiments have been described in detail, those with skill in the art will understand that the preceding embodiments and variations can be modified to incorporate various types of substitute and/or additional or alternative materials, relative arrangement of elements, and dimensional configurations.

Accordingly, even though only few variations of the present invention are described herein, it is to be understood that the practice of such additional modifications and variations and the equivalents thereof, are within the spirit and scope of the invention as defined in the following claims.

INDUSTRIAL APPLICABILITY

The system and method answers a long felt need for a container and storage apparatus wherein a labeling portion is attached to, and yet functionally separated from, the agent containing chamber. Particularly in the manufacture of plastic containers, where small size of the container, or the migration of labeling indicia and associated substances across the wall of the apparatus, may restrict labeling options, the instant invention provides a safe and secure location for the placement of indicia.

I claim:

1. A disposable single-use container and storage apparatus containing a predetermined agent, wherein the apparatus has a proximal end and a distal end, comprising:

a primary chamber, having at least one interior surface in contact with the agent and at least one exterior surface in contact with a surrounding environment;

a removable cap, releasably attached to the primary chamber and substantially near the distal end of the apparatus, having at least one gripping surface, such that a dispensing point capable of placing the inner surface of the primary chamber in fluid communication with a surrounding environment is formed when the removable cap is removed from the apparatus; and a labeling portion, attached to the apparatus which comprises at least one interior surface, at least one exterior surface and at least one pressure equalization channel wherein said equalization channel allows the surrounding environment to be in fluid contact with said at least one interior surface of the labeling portion.

2. The apparatus of claim 1, wherein the removable cap further includes at least one cap chamber wherein the cap chamber is in fluid communication with the primary chamber across a frangible break line, such that the dispensing point is formed when the removable cap is removed from the apparatus at the frangible break line.

3. The apparatus of claim 1, wherein the labeling portion is substantially cylindrical in shape.

4. The apparatus of claim 1, further including at least one indicia located on the labeling portion.

5. The apparatus of claim 4, wherein the at least one indicia is formed in the labeling portion.

6. The apparatus of claim 4, wherein the at least one indicia is integral to at least one shrink-wrap sleeve that is mounted to the labeling portion.

7. The apparatus of claim 1, further including a contamination barrier region formed between the labeling portion and the primary chamber.

8. The apparatus of claim 1, made by a blow-fill-seal method.

9. The apparatus of claim 1, wherein the apparatus is formed in a color associated with the predetermined agent.

10. The apparatus of claim 1, wherein the apparatus is formed in a shape associated with the predetermined agent.

11. The apparatus of claim 1, wherein the apparatus is formed from a thermoplastic.

12. The apparatus of claim 11, wherein the thermoplastic is selected from a group consisting of polycarbonate, polyethylene, polyester, polystyrene, polypropylene, polysulfone, polyurethane, polyvinyl chloride, and ethylene-vinyl-acetate.

13. The apparatus of claim 1, wherein the labeling portion is attached to the primary chamber substantially near the proximal end of the apparatus.

14. The apparatus of claim 1, wherein the labeling portion is attached to the removable cap substantially near the distal end of the apparatus.

15. A storage apparatus containing a predetermined agent, wherein the apparatus has a proximal end and a distal end, comprising:

a primary chamber, having at least one interior surface in contact with the agent and at least one exterior surface in contact with a surrounding environment;

a removable cap, integrally molded to the primary chamber and substantially near the distal end of the apparatus, having at least one gripping surface, such that a dispensing point capable of placing the inner surface of the primary chamber in fluid communication with the surrounding environment is formed when the removable cap is removed from the apparatus, wherein the removable cap further includes at least one cap chamber wherein the cap chamber is in fluid communication with the primary chamber across a frangible break line, such that the dispensing point is formed when the removable cap is removed from the apparatus at the frangible break line; and a labeling portion, attached to the apparatus, having at least one interior surface and at least one exterior surface;

and a contamination barrier region formed between the labeling portion and the primary chamber.

16. The apparatus of claim 15, wherein the labeling portion is substantially cylindrical in shape.

17. The apparatus of claim 15, further including at least one indicia located on the labeling portion.

18. The apparatus of claim 17, wherein the at least one indicia is formed in the labeling portion.

19. The apparatus of claim 17, wherein the at least one indicia is integral to at least one shrink-wrap sleeve that is mounted to the labeling portion.

20. The apparatus of claim 15, made by a blow-fill-seal method.

21. The apparatus of claim 15, wherein the apparatus is formed in a color associated with the predetermined agent.

22. The apparatus of claim 15, wherein the apparatus is formed in a shape associated with the predetermined agent.

23. The apparatus of claim 15, wherein the apparatus is formed from a thermoplastic.

24. The apparatus of claim 23, wherein the thermoplastic is selected from a group consisting of polycarbonate, polyethylene, polyester, polystyrene, polypropylene, polysulfone, polyurethane, polyvinyl chloride, and ethylene-vinyl-acetate.

25. The apparatus of claim 15, wherein the labeling portion is attached to the primary chamber substantially near the proximal end of the apparatus.

26. The apparatus of claim 15, wherein the labeling portion is attached to the removable cap substantially near the distal end of the apparatus.

27. A disposable single-use container and storage apparatus made by a blow-fill-seal method, containing a predetermined agent, wherein the apparatus has a proximal end and a distal end, comprising:

a primary chamber, having at least one interior surface in contact with the agent and at least one exterior surface in contact with a surrounding environment;

a removable cap, integrally molded to the primary chamber and substantially near the distal end of the apparatus, having at least one gripping surface, such that a dispensing point capable of placing the inner surface of the primary chamber in fluid communication with the surrounding environment is formed when the removable cap is removed from the apparatus, wherein the removable cap further includes at least one cap chamber wherein the cap chamber is in fluid communication with the primary chamber across a frangible break line, such that the dispensing point is formed when the removable cap is removed from the apparatus at the frangible break line; and a labeling portion, substantially cylindrical in shape, attached to the apparatus, having at least one interior surface and at least one exterior surface, and including at least one pressure equalization channel allowing the surrounding environment to be in fluid contact with the at least one interior surface of labeling portion; and a contamination barrier region formed between the labeling portion and the primary chamber.

* * * * *